United States Patent [19]

Rado et al.

[11] 3,956,664

[45] May 11, 1976

[54] MULTIPLE AIR GAP SPARK PLUG

[75] Inventors: William G. Rado; Allen H. Turner, both of Ann Arbor, Mich.

[73] Assignee: Ford Motor Company, Dearborn, Mich.

[22] Filed: Mar. 6, 1975

[21] Appl. No.: 556,031

[52] U.S. Cl. ..... 315/58; 313/140; 313/141

[51] Int. Cl.[2] ..... H01T 13/20

[58] Field of Search ..... 313/140, 141; 315/58

[56] References Cited

UNITED STATES PATENTS

| | | | |
|---|---|---|---|
| 1,531,544 | 3/1925 | Coy et al. | 313/140 |
| 1,548,556 | 8/1925 | Schmidt | 313/140 |
| 2,320,617 | 6/1943 | Landrum | 313/140 X |

*Primary Examiner*—R. V. Rolinec
*Assistant Examiner*—Darwin R. Hostetter
*Attorney, Agent, or Firm*—Robert A. Benziger; Keith L. Zerschling

[57] ABSTRACT

A multiple air gap spark plug is provided with an unobstructed air gap spark generating region between the primary electrodes. The high voltage or primary electrodes are arranged to be in confronting relation for spark generation with the intermediate or secondary electrodes arranged to be on either side of the straight line path between the high voltage electrodes. The resulting sparks generated in each air gap between adjacent electrodes will coalesce into a single spark kernel existing between the primary electrodes and laterally bounded by the secondary electrodes.

7 Claims, 4 Drawing Figures

MULTIPLE AIR GAP SPARK PLUG

CROSS REFERENCE TO RELATED APPLICATIONS

The present invention is an improvement in the invention disclosed and claimed in copending commonly assigned U.S. Pat. application Ser. No. 536,664 filed on Dec. 26, 1974 in the name of George W. Pratt, Jr. and titled "Multiple Air Gap Spark Plug" and is an improvement in the invention disclosed and claimed in copending commonly assigned U.S. Pat. application Ser. No. 536,665 filed on Dec. 26, 1974 in the names of William G. Rado et al. and titled "Multiple Air Gap Spark Plug Having Resistive Electrode Coupling".

BACKGROUND OF THE INVENTION

1. Field of the Invention

The present invention is directed to the field of spark generating devices in general. More particularly, the present invention is directed to that portion of the above-noted field which is concerned with the generation of an electrical spark for purposes of ignition of an air/fuel mixture. More particularly still, the present invention is directed to that portion of the above-noted field which is concerned with devices for generating a spark for igniting the air/fuel mixture of an automotive internal combustion engine. More particularly still, the present invention is directed to that portion of the above-noted field which is concerned with the generation of electrical sparks capable of igniting air/fuel mixtures having excess quantities of air or which have been diluted by the inclusion of combustion by-products through recirculation of exhaust gases (hereinafter collectively referred to as "lean charges"). More particularly still, the present invention is directed to that portion of the above-noted field which is concerned with multiple air gap spark generation for the ignition of a lean charge.

2. Description of the Prior Art

The above-noted copending commonly assigned patent applications describe spark plug devices having multiple air gaps formed by arranging the high voltage and ground electrode of the spark plug device (hereinafter referred to as the primary electrodes) at a very great spatial separation and by interposing one or more intermediate or secondary electrodes in the air gap so formed to define a plurality of linearly arranged air gaps. These intermediate electrodes are coupled by high impedance means, such as for example capacitive coupling or resistive coupling, to a source of voltage which is electrically stable, at least for the time period during which the spark generation occurs. This arrangement has been observed to cause the multiple air gaps so formed to be sequentially broken down and, once broken down, to remain broken down until all of the applied electrical energy has been dissipated. These devices have been shown to achieve their principle objectives in generating an effective spark length which may be made to be several multiples of the spark length which may be generated in a single air gap with a particular applied voltage differential. These spark plugs have shown themselves to be capable of reliably igniting lean charges. However, in the use of these spark plugs it has been observed that each of the individual air gaps appears to be sustaining an individual spark.

The technical literature directed to analysis of the propagation of a flame front in a lean charge reports that an "ignition delay" occurs between the application of energy to generate and sustain an electrical spark and generation of the flame front which will cause combustion of the lean charge. Thus, in the spark plug devices according to the above-noted copending applications, the generation of a plurality of individual sparks is accompanied by a plurality of "ignition delays" in achieving ignition of the lean charge. In order to prevent the occurrence of multiple "ignition delays" while otherwise achieving the objectives of the above-noted inventions, it is an object of the present invention to provide a multiple air gap spark plug device capable of generating a single spark kernel. It is also an object of the present invention to provide an improvement in the spark plug devices according to the copending commonly assigned patent applications identified above by providing a spark plug device having multiple air gap forming secondary electrodes which may sequentially generate a plurality of sparks which may thereafter coalesce into a single spark kernel.

Such an individual spark kernel is capable of producing higher internal temperatures which will aid in the ignition of lean charges. It is therefore a further and specific object of the present invention to provide a multiple air gap spark generating device having a plurality of spark electrodes arranged for generation of a single, hotter, spark kernel. In the accomplishment of the foregoing objective, it is an object of the present invention to provide a multiple air gap spark plug device having a pair of high voltage or primary electrodes with one or more secondary electrodes wherein the primary electrodes are arranged to define a spark gap and each secondary electrode is positioned to have a sparking surface which is proximate to, but which does not obstruct, the spark gap defined by the primary electrodes. It is also an object of the present invention to provide such a device which may be conveniently and readily manufactured using present production facilities.

SUMMARY OF THE PRESENT INVENTION

A spark plug device having a pair of high voltage or primary electrodes, one of which is communicated to a housing portion of the spark plug device and the other of which is communicated to an electrical terminal of the spark plug device, is provided with at least one secondary electrode member having a high impedance electrical connection to either of the primary electrodes. The primary electrodes are arranged to have sparking surfaces which are in confronting and spaced apart relation to define a spark gap and the at least one secondary electrode member is provided with a sparking surface which is positioned to define a portion of at least one of the lateral boundaries of the spark gap region as established by the primary electrodes. The at least one secondary electrode member may intrude into, but must not obstruct, the spark gap region defined by the primary electrodes.

DETAILED DESCRIPTION OF THE PREFERRED EMBODIMENT

Figure 1:
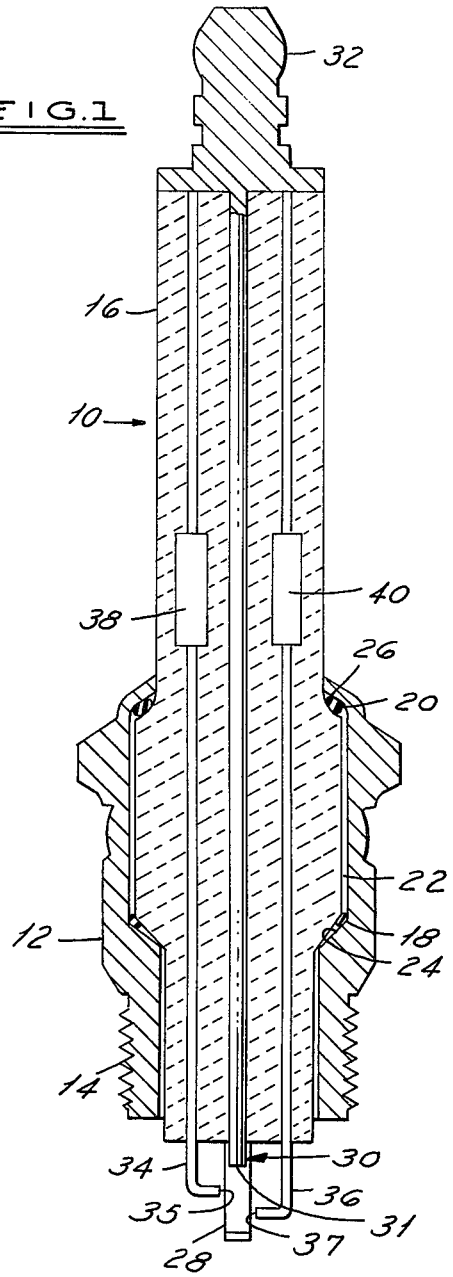
FIG. 1 illustrates a sectional view of a spark plug device incorporating the present invention.

Referring now to the drawing, wherein like numbers designate like structure throughout the various views thereof, a spark generating device or spark plug 10 for ignition of an air/fuel mixture combustion charge in a combustion chamber of an internal combustion engine is shown in FIG. 1. Spark generating device 10 includes conductive, preferably metallic, housing structure 12 which is threaded on one end, as at 14, for receipt within a suitably threaded port in an internal combustion engine combustion chamber. Since such engines and spark plug usages are notoriously well known, it is believed that illustration of such engines is not necessary to an understanding of our invention. A ceramic dielectric material insulating member 16 is received within housing portion 12. Seal means 18, 20 are arranged on opposite sides of shoulder portion 22 of the ceramic dielectric material 16. Seal means 18 cooperates with shoulder portion 24 of the housing member 12 while seal means 20 cooperates with a shoulder portion 26 of housing member 12 to rigidly retain insulating member 16 within housing 12 in fluid tight fashion.

Ground electrode 28 is formed as a portion of, and is therefor connected to, housing 12 and is arranged to extend away from the threaded end portion 14 of housing 12. High voltage electrode 30 extends through the central body portion of the insulating member 16 and terminates in a metallic cap portion 32. Cap portion 32 is adapted for connection to the electrical ignition system, not shown, of an internal combustion engine. Since ignition systems for internal combustion engines are notoriously well known, illustration of a representative ignition system is believed to be unnecessary. As is normally the practice, insulating member 16 is formed of a ceramic dielectric material and is generally cylindrical in form. The high voltage electrode 30 extends generally along the axis thereof and terminates in sparking surface 31 at the end opposite cap portion 32. Ground electrode 28 is configured to place a sparking portion or surface in an axially confronting relationship to the sparking surface 31 of high voltage electrode 30. Ground electrode 28 and high voltage electrode 30 comprise the primary electrodes. As thus described, spark generating device 10 comprises a substantially conventional spark plug device intended for use in igniting the combustible air/fuel charge in an internal combustion engine. The axial spacing between the confronting portion of electrode 28 and electrode 30 defines an air gap in which electrical sparking will occur when a sufficiently large potential is applied between metallic cap 32 and housing portion 12 by an ignition system. The ignition system of the internal combustion engine may be arranged to maintain housing portion 12 either electrically negative, or electrically positive, with respect to the potential applied to metallic cap 32.

A pair of secondary electrodes 34, 36 are arranged to extend from the insulating member 16 and are positioned to provide sparking surfaces 35, 37 laterally at a side of the air gap longitudinally defined by the confronting portions of the primary electrode members 28, 30. Secondary electrode members 34, 36 are arranged so that their associated sparking surfaces 35, 37 define portions of the lateral boundaries of the major spark gap whose length is defined by the primary electrodes 28, 30. Secondary electrodes 34, 36 are further arranged to define a plurality of smaller or lesser air gaps generally within the major spark air gap. Preferably, these lesser air gaps are arranged to be substantially equal in length and may be substantially equal to, or smaller than, the maximum gap which may be broken down by the selected energizing voltage. In accordance with the present invention, the secondary electrodes 34, 36 are situated to avoid obstruction of the straight line path between the sparking surfaces of the primary electrodes 28, 30.

Each secondary electrode member 34, 36 is provided with high resistance electrical means intercommunicating the associated secondary electrode member 34, 36 with an electrical circuit location at an electric potential which is substantially constant during the air gap break down period. In the illustrated embodiment, this substantially constant electric potential is the high voltage potential established for the electrode 30 of the spark plug device 10 by the associated electrical ignition system. The high resistance coupling is achieved by connecting the secondary electrodes 34, 36 with resistors 38, 40 embedded within insulator 16 and by connecting the resistors 38, 40 to the cap 32 to form a ladder-type resistance network.

Figure 2:
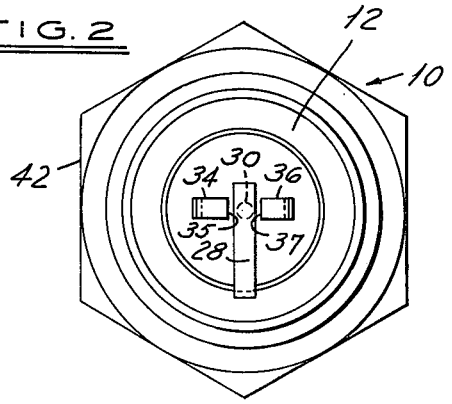
FIG. 2 illustrates an end view of the spark plug device of FIG. 1.

Referring now to FIG. 2, an end view of a spark plug member 10 having electrode members fabricated according to one embodiment of the present invention illustrates the interrelationship of the various electrode members. The high voltage potential electrode 30 is illustrated by a phantom line as lying at the approximate axial center line of the generally cylindrical insulating member 16. The secondary electrode members 34, 36 are arranged to position their sparking surfaces 35, 37 to a side of, and out of the straight line path between, central electrode member 30 and the ground electrode 28. Ground electrode member 28 is connected to housing portion 12 and arranged to overlap the other primary electrode member. Thus, the primary electrode members 28, 30 define a principal air gap which extends axially from spark plug 10. As illustrated in this embodiment, housing portion 12 is provided with a hexagonal wrench gripping portion 42 in the conventional manner.

As can be seen from a consideration of FIGS. 1 and 2, the primary electrode members 28, 30 and the secondary electrode members 34, 36 are arranged to be spatially separated, one from the other, and to define between adjacent electrode pairs a plurality of secondary spark air gaps which are aligned generally along the axis of insulating member 16 but which are offset with respect thereto. The spark forming air gaps thus formed are continuous in a substantially linear direction without being interrupted by the secondary electrode members 34, 36. Depending on combustion charge distribution, the air gaps could also be arranged to deviate substantially from the center line of the spark plug 10. It will be appreciated that the actual placement of the secondary spark gaps (that is, the individual spark gaps defined by adjacent pairs of electrodes) is not critical to the present invention. It will also be appreciated that the illustrated arrangement will enable a generated spark to penetrate deeply into a combustion charge. In the instance of a lean charge, the larger total spark length and deep penetration will assure ignition of the combustion charge.

Figure 4:
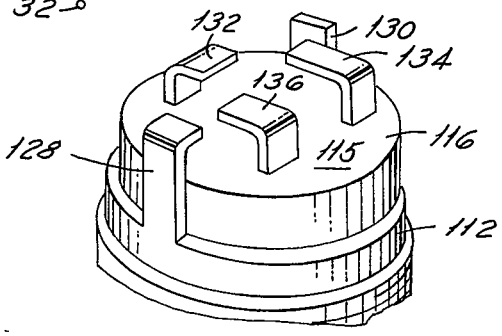
FIG. 4 is an alternate embodiment of a spark plug device according to the present invention.

Referring now to FIG. 4, an end view of an alternate embodiment of the present invention is shown in a perspective view. In this Figure, the ground electrode 128 is connected to, and is a portion of, housing 112 as in the FIG. 2 embodiment. However, high voltage electrode 130 is offset from the axial centerline of dielectric insulator 116. Primary electrode members 128 and 130 cooperate to define a principal spark gap which extends generally parallel to and along the end surface 115 of dielectric insulator 116. The secondary electrode members 132, 134 and 136 project from the dielectric material 116 and are disposed on either side of the principal gap defined by primary electrode members 128 and 130. The secondary electrode members 132, 134 and 136 are positioned to avoid interrupting or obstructing the straight line path between the primary electrode members 128, 130. The secondary electrode members 132, 134, 136 present sparking surfaces which define generally the lateral boundaries of the principal gap. While the FIG. 4 embodiment has illustrated a spark plug according to the present invention having three secondary electrodes and the embodiment of FIGS. 1 and 2 has shown two secondary electrodes, the number of secondary electrodes may be as few as one or as numerous as space limitations permit. The actual number of secondary electrodes utilized will be a function of the desired size of the principal spark and the optimum size of each of the secondary gaps. The latter spacing will be, of course, a function of the associated ignition system.

Figure 3:
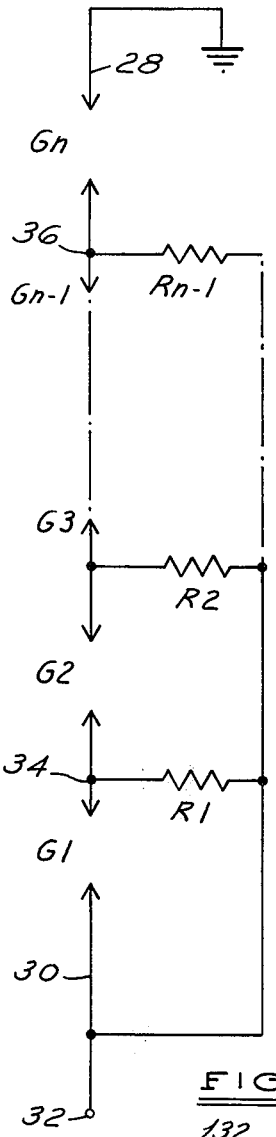
FIG. 3 is a circuit diagram illustrating the electrical operation of the spark plug device of FIG. 1.

Referring now to FIG. 3, a circuit illustrative of the operation of the spark plug 10 is shown. The various spark plug electrodes 28, 30, 34 and 36 are illustrated as being the circuit junctions on either side of the spark gaps identified as G1, G2 and GN. The gaps identified as G3 and GN-1 represent the gaps as would be defined by additional secondary electrode members. The intermediate electrodes 34, 36 are shown as being resistively connected to the cap 32 and hence the central electrode by resistances identified as R1, and RN-1. In each instance, the resistance value of the resistances R1, R2 and RN-1 is selected to be very much larger than the resistance of the arc produced in the associated gaps G1, G2, G3, GN-1 and GN. This prevents any substantial energy dissipation occurring in the resistances to the detriment of the generated spark.

In operation, a high voltage pulse would be applied to cap terminal 32 and to electrode 30 by an ignition system, not shown. This high voltage pulse could be generated by any of the known ignition systems in the conventional manner and may be at the level of energization normally utilized in automotive vehicle ignition systems. Each intermediate electrode 34, 36 would, at that point in time of initiation of the pulse, be brought to substantially the same high voltage potential through the resistive network since there would be no current flowing until the first gap breaks down. The presence of a large voltage signal on electrode 36 would operate to produce a large voltage differential across air gap GN to thereby break down the air gap GN and create a spark discharge. The voltage appearing on electrode 36 would thereafter drop to a value very close to the ground potential compared to the potential applied to the cap terminal 32. The spark across air gap GN would be maintained by current flow through the ionized gap and little energy would be dissipated because of the high resistance of the then-series connected resistor RN-1. The breakdown of air gap GN-1 will occur as a result of the potential on electrode 36 going very close to the ground potential while the potential appearing on the adjacent electrode remains high. This sequence would continue until electrode 34 was approaching the ground potential as a result of the breakdown of gap G2. The energizing voltage applied to electrode 30 will thereafter cause gap G1 to break down. With the removal of the resistances R1 through RN-1 from an electrical series relationship with the spark gaps, full energy dissipation within the gaps can commence.

With the prior art spark generating devices as described in the cross referenced copending patent applications, the sparks appearing in each of the individual gaps will behave, during the full energy dissipation sequence, as a plurality of individually generated and individually maintained sparks. Each of these individual sparks will exhibit an "ignition delay" which, combined with the fact that each of the individual spark gaps will be dissipating a fraction of the total energy available for dissipation in the spark generating device will result in a measurable delay between commencement of energy dissipation and the establishment of a self-sustaining flame front within the lean charge. The present invention achieves its desirable benefit by arranging the secondary electrodes so as to define a plurality of secondary spark gaps which, upon break down of the last secondary spark gap will generate a plurality of individual sparks which may thereafter coalesce into a single spark kernel which is not interrupted by the intrusion of any of the secondary electrode members. This single spark kernel will exhibit an "ignition delay" representative of a single spark which will be measurably less than the "ignition delay" exhibited by the devices according to the cross-referenced patent applications. Additionally, the absence of any secondary electrodes intruding within the principal spark gap will avoid the presence of any heat sinks within the spark zone to thereby provide a spark which is hotter than would be obtainable by the prior art spark plug devices.

It will be appreciated that other electrical arrangements for providing high impedance coupling between the intermediate electrode and a stable or relatively constant level of voltage are conceivable. For example, resistances can be located externally of the spark plug device. Furthermore, each of the intermediate electrodes could be resistively connected to the grounded electrode 28 or to the spark plug housing 12. This form of resistive coupling would operate under substantially the same constraints as set forth in our copending commonly assigned patent applications cross-referenced hereinabove. Alternatively, capacitive coupling as described in and claimed in the copending commonly assigned U.S. Pat. application Ser. No. 536,664 fully described hereinabove could also be employed.

It will be appreciated that the present invention readily accomplishes its stated objectives. By arranging the primary electrode members to define a longitudinally extending spark gap and by positioning the secondary electrode members to establish lateral boundaries for the longitudinally extending spark gap a plurality of secondary spark gaps are provided which may be sequentially broken down. Once broken down, the sparks so formed may coalesce to form a single spark kernel having improved ignition characteristics for igniting a lean charge.

We claim:

1. In a spark generating device for igniting a lean charge, the device having a pair of primary electrodes adapted for electrical communication to a source of sparking energy and maintained in insulated spaced apart relation by insulator means to define a longitudinally extending principal spark gap, the improvement comprising:

at least one secondary electrode member extending from the insulator means and positioned adjacent to, but not obstructing, the principal spark gap;

said at least one secondary electrode member having a sparking surface defining a lateral boundary of the principal spark gap; and means for electrically coupling said at least one secondary electrode member through an electrical high impedance to a stable voltage source.

2. The spark generating device of claim 1 including a plurality of secondary electrode members extending from the insulator means and electrically mutually insulated from each other and from the primary electrode members;

said plurality of secondary electrode members including at least one each disposed on two opposite lateral sides of the principal air gap and having sparking surfaces defining the lateral boundaries thereof; and said electrical coupling means comprise a plurality of electrical high impedance means interconnecting each of said plurality of secondary electrodes to a stable voltage source.

3. The spark generating device of claim 1 wherein the principal spark gap extends away from the insulator means.

4. The spark generating device of claim 1 wherein the principal spark gap extends generally parallel to the end surface of the insulator means.

5. In a spark generating device of the type having a pair of primary electrode members adapted for electrical communication with a source of sparking energy and maintained in spaced apart relation by insulator means to define a longitudinally extending principal spark gap, the improvement comprising:

at least one secondary electrode member extending from the insulator means and positioned in proximity to the principal spark gap operative to define a plurality of secondary spark gaps;

said at least one secondary electrode member being arranged to permit an unobstructed straight line path between the primary electrode members to be established; and means for electrically coupling said at least one secondary electrode member through an electrical high impedance to a stable voltage reference.

6. The spark generating device of claim 5 wherein said at least one secondary electrode member includes a sparking surface positioned to define a lateral boundary of the principal air gap.

7. The spark generating device of claim 5 including a plurality of secondary electrodes, cooperative with the primary electrodes to define a plurality of secondary air gaps between adjacent electrode members, each of the secondary electrode members being positioned to permit an unobstructed straight line spark path to be established between the primary electrode members.

* * * * *